US009563144B2

(12) United States Patent
Ito et al.

(10) Patent No.: US 9,563,144 B2
(45) Date of Patent: Feb. 7, 2017

(54) CHARGING DEVICE, PROCESS CARTRIDGE, AND IMAGE FORMING APPARATUS

(71) Applicant: CANON KABUSHIKI KAISHA, Tokyo (JP)

(72) Inventors: Motonari Ito, Suntou-gun (JP); Hiroyoshi Iwayama, Yokohama (JP); Takashi Hiramatsu, Tokyo (JP); Yu Fukasawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/058,991

(22) Filed: Mar. 2, 2016

(65) Prior Publication Data

US 2016/0259260 A1 Sep. 8, 2016

(30) Foreign Application Priority Data

Mar. 6, 2015 (JP) ..... 2015-045132
Feb. 17, 2016 (JP) ..... 2016-028429

(51) Int. Cl.
*G03G 15/02* (2006.01)
*G03G 21/18* (2006.01)

(52) U.S. Cl.
CPC ..... *G03G 15/0216* (2013.01); *G03G 21/1803* (2013.01)

(58) Field of Classification Search
CPC ..... G03G 15/0216; G03G 21/1803
See application file for complete search history.

(56) References Cited

U.S. PATENT DOCUMENTS 6,600,886 B2 * 7/2003 Tsukida ..... G03G 15/0216 399/167
7,194,228 B2 * 3/2007 Arimitsu ..... G03G 15/0216 399/111

FOREIGN PATENT DOCUMENTS

| | | | |
|---|---|---|---|
| JP | 2002-49228 | A | 2/2002 |
| JP | 2002-72625 | A | 3/2002 |
| JP | 2002-108069 | A | 4/2002 |
| JP | 2007-241212 | A | 9/2007 |
| JP | 2007-264100 | A | 10/2007 |
| JP | 2010-256870 | A | 11/2010 |
| JP | 4749049 | B2 | 8/2011 |
| JP | 2012-32552 | A | 2/2012 |
| JP | 2013-109191 | A | 6/2013 |

* cited by examiner

*Primary Examiner* — Hoang Ngo
(74) *Attorney, Agent, or Firm* — Canon U.S.A. Inc., IP Division

(57) ABSTRACT

A charging member includes a force receiving portion that receives a force in a direction in which the charging member is moved in a longitudinal direction of the charging member while rotating. The charging member is in contact with a brush member at a place different from the place of the force receiving portion. A component of the force received by the charging member at the force receiving portion in the longitudinal direction and a component of a force received by the charging member resulting from tilting of bristles in the brush member are in the same direction.

17 Claims, 6 Drawing Sheets

CHARGING DEVICE, PROCESS CARTRIDGE, AND IMAGE FORMING APPARATUS

BACKGROUND OF THE INVENTION

Field of the Invention

The present invention relates to a charging device for charging a surface of an image hearing member, such as a photosensitive member, to an image forming apparatus that includes the charging device and that forms an image on a recording medium, and to a process cartridge attached thereto.

Description of the Related Art

In recent years, a contact DC charging technique has been widely used as a charging device in an image forming apparatus, such as an electrophotographic apparatus or electrostatic recording apparatus. The contact DC charging technique uses a conductive charging member, in place of a corona charger, causes the charging member to abut on a photosensitive member, and evenly charges a surface of the photosensitive member, and suppresses ozone generation. One example of that technique is applying a DC bias to a charging roller, which is a charging member, performing evenly discharging while rotating the charging roller in contact with a surface of a photosensitive member, and uniformly charging the surface of the photosensitive member.

The charging roller is required to keep its location in a longitudinal direction constant to properly charge a printing area, and it is recommended that the charging roller be positioned in the longitudinal direction. One example of such a configuration is illustrated in Japanese Patent No. 4749049. The illustrated configuration has a positional relationship between the photosensitive member and charging roller in which the axis of rotation of the photosensitive member and the axis of rotation of the charging roller intersect with each other at a predetermined angle (intersect angle). In that configuration, the charging roller can receive a thrust in the longitudinal direction by being rotated and can be moved to a predetermined location.

Unfortunately, the contact DC charging technique tends to suffer charging failures because the charging roller is in direct contact with the surface of the photosensitive member and thus toner, an external additive, or other additive is apt to be attached to the surface of the charging roller. In particular, if the charging roller has no enhanced longevity or there is no cleaning member for cleaning the surface of the photosensitive member, soiling of the charging roller is a serious problem. Various means for cleaning the charging member to prevent such soling of the surface of the contact charging member have been proposed. One example configuration illustrated in Japanese Patent Laid-Open No. 2002-108069 cleans the contact charging member by using a brush.

There is a method that enables the charging roller and photosensitive member to receive a thrust in a certain direction with respect to the longitudinal direction to position the charging roller and photosensitive member in the longitudinal direction by disposing the photosensitive member and charging roller with the intersect angle formed therebetween, as described above, and, in the case where the charging roller is driven through a gear, by using a helical gear as the gear. With this method, the charging roller and photosensitive member can be moved in a predetermined direction and can be positioned.

However, when the brush member for cleaning the surface of the charging roller abuts on the surface of the charging roller, a load occurs in the charging roller. This hinders smooth movement of the charging roller in the longitudinal direction, and thus the longitudinal locations of the charging roller and photosensitive member are not constant. Although the thrust can be increased by increasing the intersect angle, this state is undesired because it destabilizes the abutment in the longitudinal direction.

SUMMARY OF THE INVENTION

The present invention provides positioning a charging member in a configuration in which the charging member is cleaned by a brush member.

The present invention provides a charging device for use in an image forming apparatus. The charging device includes a charging member and a brush member. The charging member is in contact with an image bearing member and configured to charge the image bearing member while rotating. The brush member is in contact with the charging member. The charging member includes a force receiving portion that receives a force in a direction in which the charging member is moved in a longitudinal direction of the charging member while rotating. The charging member is in contact with the brush member at a place different from a place of the force receiving portion. A component of the force received by the charging member at the force receiving portion in the longitudinal direction and a component of a force received by the charging member resulting from tilting of bristles in the brush member in the longitudinal direction are in an identical direction.

Further features of the present invention will become apparent from the following description of exemplary embodiments with reference to the attached drawings.

DESCRIPTION OF THE EMBODIMENTS

First Embodiment

Outline Of Configuration Of Image Forming Apparatus

Figure 1:
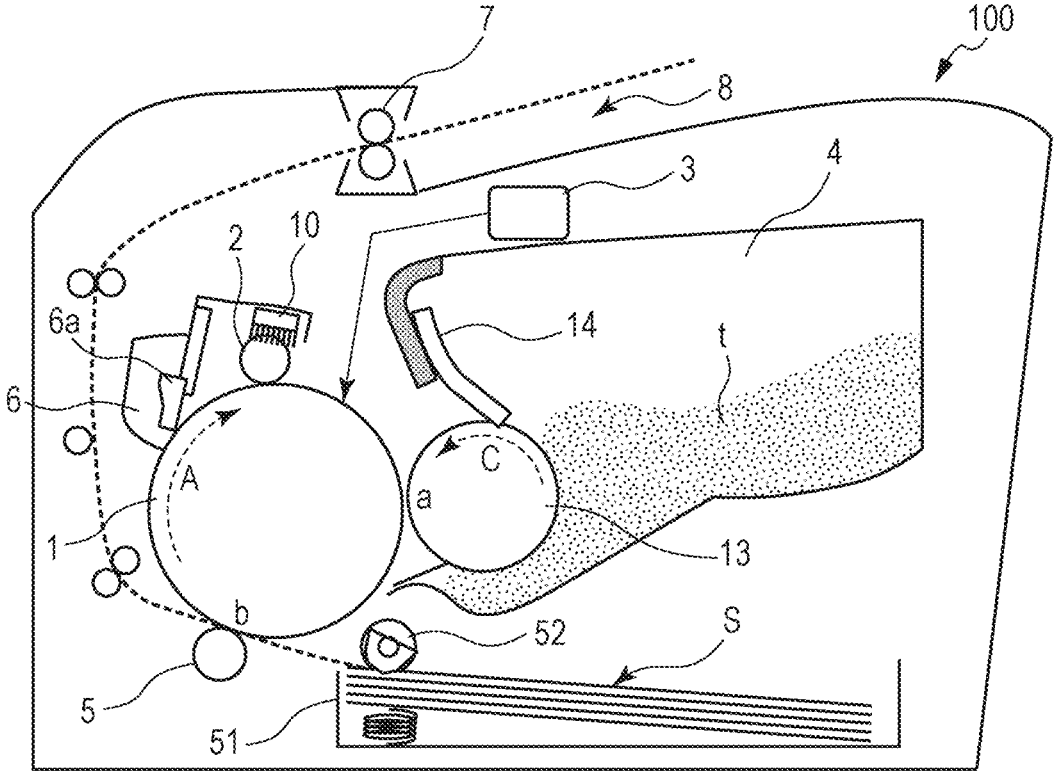
FIG. 1 is a schematic cross-sectional view of an image forming apparatus according to a first embodiment and a second embodiment.

An image forming apparatus according to the present invention is described below in further detail with reference to the drawings. Embodiments described below are used in describing the present invention for illustrative purposes. The dimensions, materials, shapes, relative arrangement of components described below do not limit the scope of the present invention thereto unless specified otherwise. An image forming apparatus 100 and an image forming process according to the present embodiment of the present invention are described below with reference to FIGS. 1 and 2.

One example of the image forming apparatus 100 according to the present embodiment is an electrophotographic image forming apparatus. When a central processing unit (CPU) (not illustrated) as a receiving unit in the image forming apparatus 100 receives a signal for image information from a personal computer or other device (not illustrated), a sheet S is conveyed from a sheet cassette 51 attached in the lower portion in the apparatus by a conveyance roller 52. In synchronization with this sheet conveyance, a photosensitive drum 1 being an image bearing member begins rotating.

The photosensitive drum 1 in the present embodiment is a negative-polarity organic photoconductor (OPC) photosensitive member of ϕ 24 mm. The photosensitive drum 1 can rotate in a direction indicated by the arrow A with a constant speed of a peripheral speed of 100 mm/sec (=process speed PS, printing speed).

Figure 2:
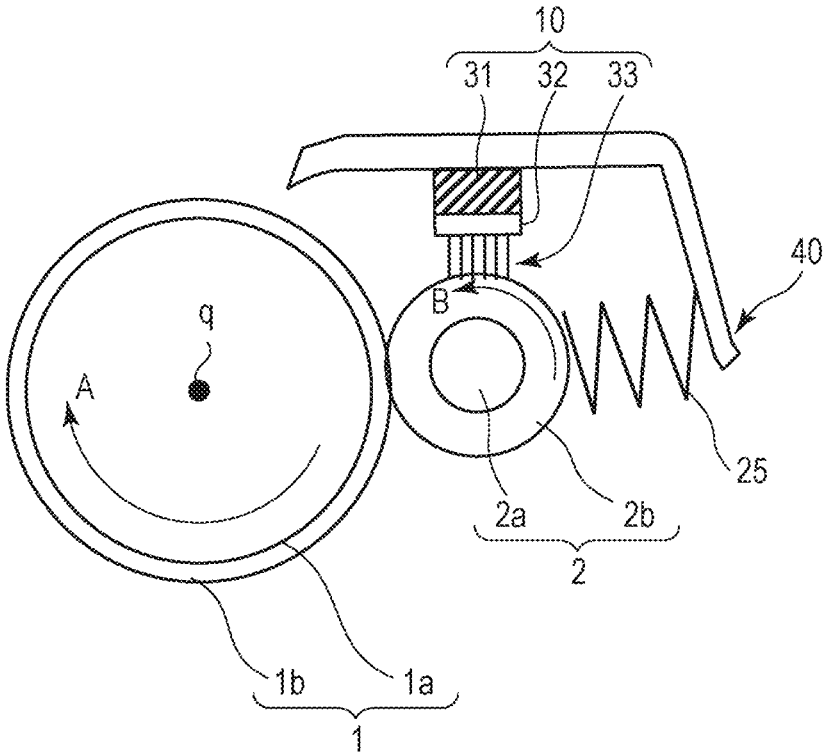
FIG. 2 is a schematic cross-sectional view of a charging roller and its vicinity according to the first embodiment.

A charging roller 2 as a charging member charges a surface of the photosensitive drum 1. As illustrated in FIG. 2, the charging roller 2 is a conductive elastic roller and includes a metal core 2*a* and a conductive elastic layer 2*b*. The charging roller 2 is made to be in pressure-contact with the photosensitive drum 1 by a predetermined pressing force, and a charging area is formed between the charging roller 2 and the photosensitive drum 1. In the present embodiment, the charging roller 2 is rotated in a direction indicated by the arrow B by following rotation of the photosensitive drum 1. The charging roller 2 receives a charging bias applied by a charging power supply (not illustrated). In the present embodiment, this charging power supply applies a direct current voltage to the metal core 2*a*. The applied direct current voltage is set at a value at which the difference between the potential of the surface of the photosensitive drum 1 and that of the charging roller 2 is equal to or larger than a discharge start voltage. Specifically, a direct current voltage of −1300 V is applied as the charging bias. At this time, the surface of the photosensitive drum 1 is uniformly charged in contact such that it has a charging potential (dark area potential) of −700 V. A brush member 10 for cleaning a surface layer of the charging roller 2 is arranged so as to abut on the charging roller 2. The charging roller 2 and brush member 10 are described later.

A laser beam scanner 3 including a laser diode and a polygon mirror is disposed as exposure means (exposure device). The laser beam scanner 3 outputs a laser beam whose intensity is modulated in accordance with a time-series electrical digital pixel signal corresponding to target image information and exposes the uniformly charged surface of the rotating photosensitive drum 1 by scanning with the laser beam. When the uniformly charged processed surface of the photosensitive drum 1 is exposed by the whole surface exposure, the laser power is adjusted such that the potential of the surface of the photosensitive drum 1 is −150 V. By exposure of the photosensitive drum 1 by the laser beam scanner 3, an electrostatic latent image (electrostatic image) is formed on the photosensitive drum 1.

A developing device (developing unit) 4 uses magnetic one-component toner having a negative polarity as a developing agent in the present embodiment. A developing sleeve 13 being a toner bearing member and a developing blade 14 are arranged. The developing sleeve 13 is rotated in a direction indicated by the arrow C. The magnetic toner is attracted to the developing sleeve 13 by magnetic force of a magnet (not illustrated) being magnetic field generating means included in the developing sleeve 13. Toner t is regulated by the developing blade 14 so as to have a predetermined layer thickness and acquires a charge having a constant negative polarity by triboelectric effect. After that, the electrostatic latent image on the photosensitive drum 1 is visualized in a developing portion a by a developing bias applied between the developing sleeve 13 and photosensitive drum 1 by a developing bias application power supply (not illustrated). The developing bias is set at −350 V. That is, a toner image (developed image) is formed on the photosensitive drum 1 by developing the latent image on the photosensitive drum 1 by the developing sleeve 13.

The photosensitive drum 1 is an image bearing member, which bears an image (toner image, latent image). The developing device 4 supplies a developing agent to the image bearing member and develops the latent image. The developing sleeve 13 in the developing device 4 is a developing agent-bearing member that bears the developing agent and develops the latent image.

A transfer roller 5 as contact transfer means has a medium resistance, is made to be in pressure-contact with the photosensitive drum 1 in a predetermined manner, and forms a transfer nip portion b. The transfer roller 5 used in the present embodiment includes a metal core with a medium-resistance foam layer and has a roller resistance value of $5\times10^{8}\Omega$. An image is transferred by application of a voltage of +2.0 kV to the metal core. That is, the toner image is transferred from the photosensitive drum 1 to a transferred material by the transfer roller 5 (transferring device, transferring member). In the present embodiment, the transferring device (transfer roller 5) directly transfers the toner image to a recording medium (sheet). An indirect transfer configuration in which the toner image is first transferred from the photosensitive drum 1 to an intermedium transfer member and it is then transferred from the intermediate transfer member to the recording medium (sheet) may also be used. In this configuration, the intermediate transfer member is a transferred material to which the toner image is transferred from the photosensitive drum 1.

Transfer residual toner slightly remaining on the surface of the photosensitive drum 1 after the completion of a transferring step is removed by a cleaning device 6. The cleaning device 6 includes a cleaning blade 6*a* having an elastic member, such as polyurethane rubber, at a leading edge portion of a support member made of sheet metal or other material. The leading edge portion of the elastic member (cleaning blade 6*a*) is made to abut on the surface of the photosensitive drum 1 by a predetermined pressing force in a so-called counter direction. In this way, the transfer residual toner is removed from the surface of the photosensitive drum 1.

A fixing device 7 as fixing means is of the heat fixing type. The sheet S passes through the transfer portion such that the toner image is transferred thereto, is separated from the surface of the rotating photosensitive drum 1, and is then introduced into the fixing device 7. The toner image on the sheet S is fixed, and the sheet S is discharged to a paper ejecting portion 8 as an image formed product (printed copy).

Figure 8:
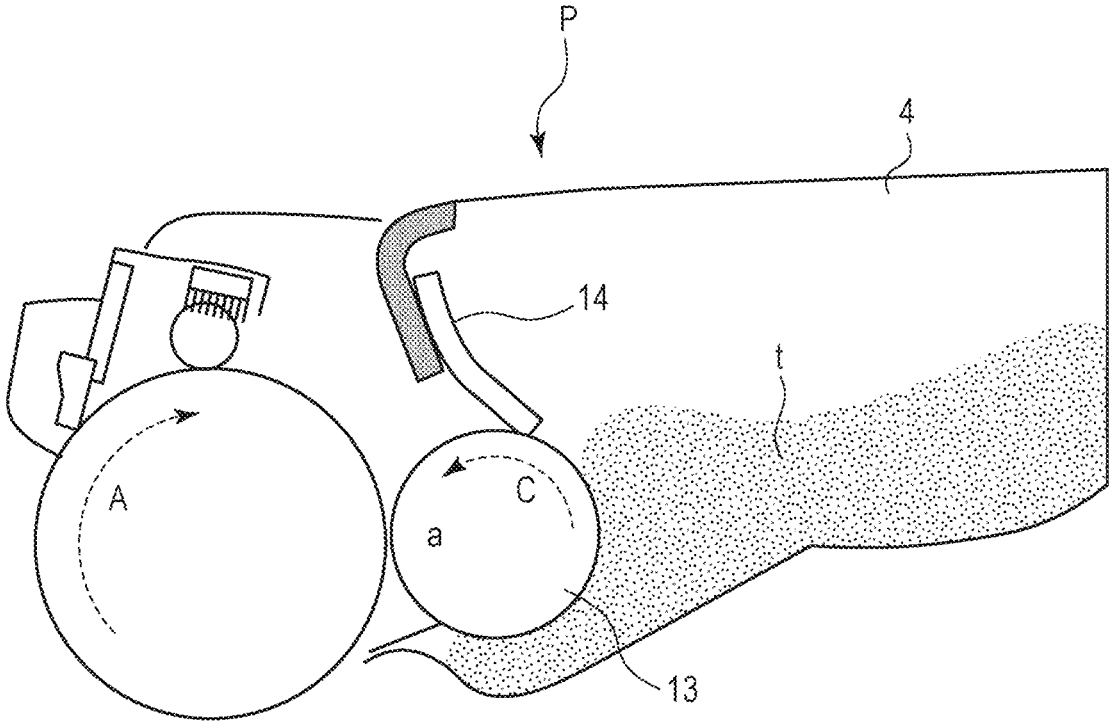
FIG. 8 illustrates a cartridge.

In the present embodiment, a process cartridge P (see FIG. 8) is attachable to and detachable from a main body of the image forming apparatus 100. The photosensitive drum 1, charging roller 2, developing device 4, and other elements as a part of the cartridge P are attachable to and detachable from the main body of the apparatus. The main body of the apparatus is a portion in which the cartridge P is eliminated from the image forming apparatus 100.

Figure 3:
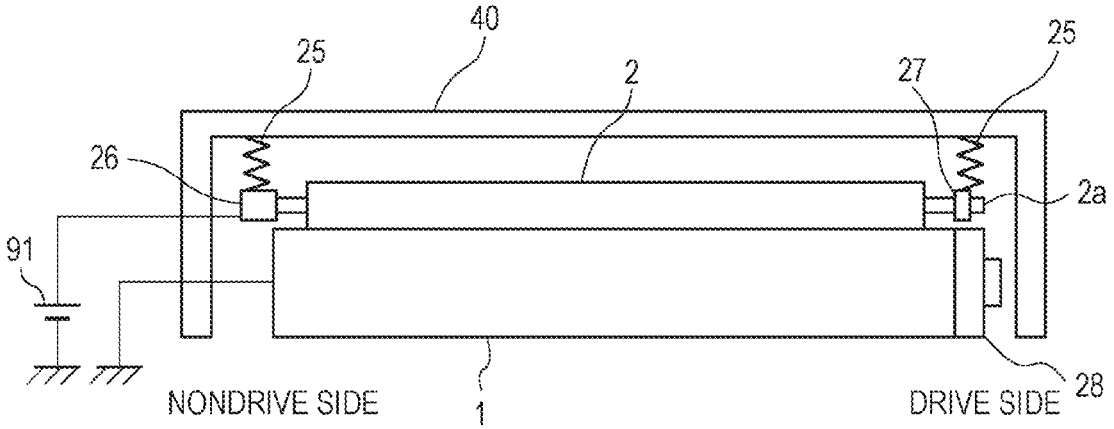
FIG. 3 is a schematic diagram that illustrates a configuration of the charging roller and a photosensitive drum according to the first embodiment.

Positional Relationship Among Photosensitive Drum, Charging Roller, And Brush Member The photosensitive drum 1, charging roller 2, and brush member 10 are described below with reference to FIGS. 2 and 3. FIG. 2 is a schematic cross-sectional view of the charging roller and its vicinity. FIG. 3 is a schematic diagram of the charging roller and its vicinity in the longitudinal direction.

In the following description, a configuration including the photosensitive drum 1, charging roller 2, and brush member 10 may also be referred to as a charging device.

The photosensitive drum 1 receives a driving force from drive means (not illustrated) in the image forming apparatus and rotates in the direction indicated by the arrow A about an axis q of rotation. The photosensitive drum 1 includes a cylinder 1*a* made of aluminum or other element and an organic photosensitive layer 1*b* applied on an outer peripheral surface of the cylinder 1*a*. A coupling member 28 as drive transferring means is disposed on an end portion of the cylinder 1*a* in the longitudinal direction. Another end portion of the photosensitive drum 1 is grounded through the image forming apparatus. In the present embodiment, the side on which the coupling member 28 is disposed in the longitudinal direction of the photosensitive drum 1 and charging roller 2 is referred to as a drive side, whereas the side opposite the drive side is referred to as a nondrive side. The photosensitive drum 1 receives a driving force from the drive side, on which the coupling member 28 is disposed.

As previously described, the charging roller 2 includes the metal core 2*a* and the conductive elastic layer 2*b* disposed around the metal core 2*a* and has a roll shape having an outer diameter of 10 mm and a longitudinal length of 230 mm. A stainless steel bar of a diameter of 6 mm and with nickel plating is used as the metal core 2*a*.

The opposite end portions of the metal core 2*a* are supported on bearings 26 and 27, respectively, such that the metal core 2*a* is freely rotatable. The bearings 26 and 27 are urged to the photosensitive drum 1 by a pressurizing spring 25 with a predetermined pressure S (3 to 9 N). This spring pressure makes the charging roller 2 abut on the photosensitive drum 1, and the charging roller 2 is rotated by following rotation of the photosensitive drum 1.

Each of the bearings 26 and 27 is made of a member having good sliding characteristics, such as polyoxymethylene (POM). In the present embodiment, the bearing 26 on the nondrive side is included in a feeding path for feeding a charging bias from a charging power supply 91 to the charging roller 2. Thus, the bearing 26 is the one in which a conductive filler, such as carbon, is uniformly dispersed, and its resistance is $10^1$ to $10^3$ Ω·m.

In the present embodiment, the charging roller 2 is positioned on the feeding path side to make sure that it receives electricity, and the charging roller 2 moves toward the nondrive side. Thus, the bearing 26 has a metal core receiving surface for receiving the metal core 2*a* in the charging roller 2.

Figure 4:
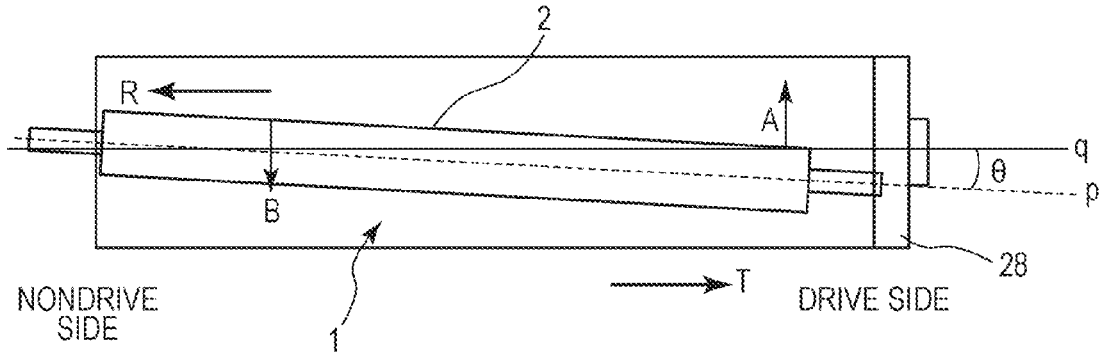
FIG. 4 is a schematic diagram that illustrates an abutment state of the charging roller and photosensitive drum according to the first embodiment.

FIG. 4 is a schematic diagram that illustrates an abutment state of the photosensitive drum 1 and charging roller 2. As illustrated in FIG. 4, in the form of the present embodiment, the charging roller 2 is arranged in contact with the photosensitive drum 1 such that the axis q of rotation of the photosensitive drum 1 and an axis p of rotation of the charging roller 2 form a predetermined intersect angle θ. The charging roller 2 is inclined such that the drive side of the charging roller 2 in the longitudinal direction is upstream with respect to the nondrive side in the rotational direction of the photosensitive drum 1 as seen from above the charging roller 2.

When the photosensitive drum 1 in the direction indicated by the arrow A begins rotating, the charging roller 2 is rotated in the direction indicated by the arrow B by following that rotation. Because of the intersect angle θ, the charging roller 2 receives a thrust R toward a direction indicated by the arrow R (a predetermined force acting in the axial direction (longitudinal direction) (acting so as to move the charging roller 2 in the longitudinal direction)) along the direction of the axis p of rotation (longitudinal direction).

That is, because the photosensitive drum 1 is inclined with respect to the charging roller 2, a friction force occurring between the charging roller 2 and photosensitive drum 1 during the rotation of the photosensitive drum 1 and charging roller 2 acts on the charging roller in the longitudinal direction. That is, the charging roller 2 receives the thrust R from a contact portion (force receiving portion) being in contact with the photosensitive drum 1.

The photosensitive drum 1 receives a thrust T in a direction indicated by the arrow T along the axis q of rotation. In the present embodiment, the axis q of rotation of the photosensitive drum 1 and the axis p of rotation of the charging roller 2 intersect with each other in the vicinity of a central portion of the charging roller 2 in the longitudinal direction, and the absolute value of its intersect angle θ is set at 0.3±0.1°.

Tilting Treatment of Brush Member 10

Figure 5:
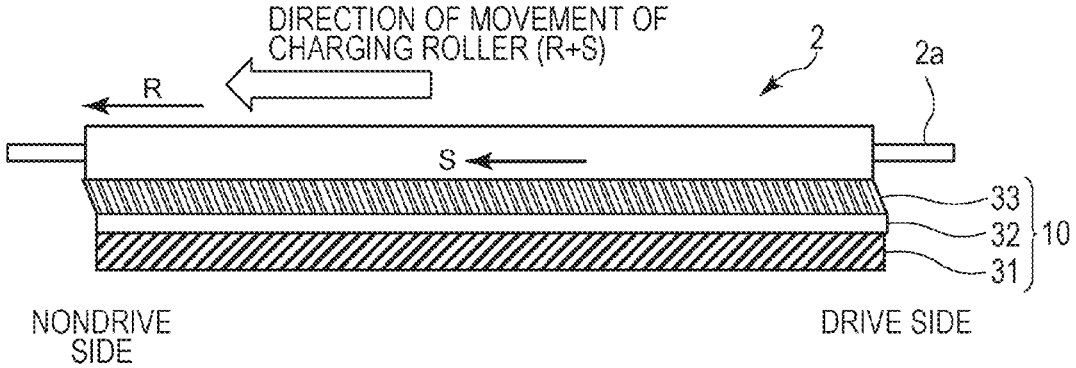
FIG. 5 is a schematic diagram that illustrates a configuration of the charging roller and a brush member according to the first embodiment.

The relationships between the charging roller 2 and brush member 10 and advantages are described with reference to FIG. 5. The brush member 10 is disposed on a frame 40 such that it is in contact with the surface of the charging roller 2. The brush member 10 includes an elastic layer 31, support member 32, and bristles 33. The bristles 33 are made of resin, such as nylon or rayon, each have a length of 2 mm and a thickness of 30 μm, and are sewed into the support member 32 with a density of the order of 30,000 pieces/$cm^2$. Supporting the brush portion by the elastic layer 31 enables the brush member 10 to be in contact with the charging roller 2 with stability and can prevent the bristles 33 from being deformed by a contact pressure of contact with the charging roller 2. The bristles 33 may have the same potential as that of the charging roller 2, and thus the resistance of each of the support member 32 and bristles 33 may be approximately $10^2$ to $10^8$ Ω·m. In the present embodiment, the bristles 33 are subjected to tilting treatment of tilting the bristles toward the nondrive side in the longitudinal direction. In the present embodiment, the angle of tilting of the bristles is approximately 30° from the roots toward the ends. That is, the bristles are tilted approximately 30° with respect to a plane perpendicular to the axis p of rotation of the charging roller 2.

An example common way of the tilting treatment is bending the bristles 33. Another common way is setting the bristles 33 in a slanting direction in implanting the bristles 33 in the support member 32.

With the above-described configuration, the surface of the charging roller 2 is cleaned by the bristles 33 in the brush member 10. In addition, because the bristles 33 are subjected to tilting treatment toward the nondrive side in the longitudinal direction, when the charging roller 2 begins rotating in the state where it abuts on the brush member 10, the charging roller 2 receives a thrust S in a direction indicated by the arrow S (second force acting in the longitudinal direction of the charging roller 2 (acting so as to move the charging roller 2 in the longitudinal direction)) at that abutment portion.

The thrust S here and the previously described thrust R (force received by the charging roller 2 from the photosensitive drum 1) act in the same direction in the longitudinal direction. That is, a longitudinal component (thrust S) of the force received by the charging roller 2 from the brush member 10 at the abutment portion abutting on the brush member 10 and a longitudinal component (thrust R) of the force received by the charging roller 2 from the photosensitive drum 1 at the contact portion (force receiving portion) being in contact with the photosensitive drum 1 are in the same direction.

That is, the charging roller 2 receives different forces at different places, i.e., the contact portion (force receiving portion) being in contact with the photosensitive drum 1 and the contact portion being in contact with the brush member 10. Because these two forces, that is, thrust R and thrust S, act in the same direction in the longitudinal direction, the charging roller 2 smoothly moves to the nondrive side, which is a direction in which the forces act.

Accordingly, the charging roller 2 can be positioned to a desired location inside the charging device with stability.

The setting of the bristles 33 illustrated in the present embodiment is merely one example. The bristles may have any setting that enables cleaning the surface of the charging roller 2 and allows a predetermined thrust to be exerted on the charging roller.

Second Embodiment

A second embodiment of the present invention is described below. The second embodiment differs from the first embodiment in that the charging roller 2 is a driving configuration and the cleaning device 6 is not included.

Cleanerless System

Figure 9:
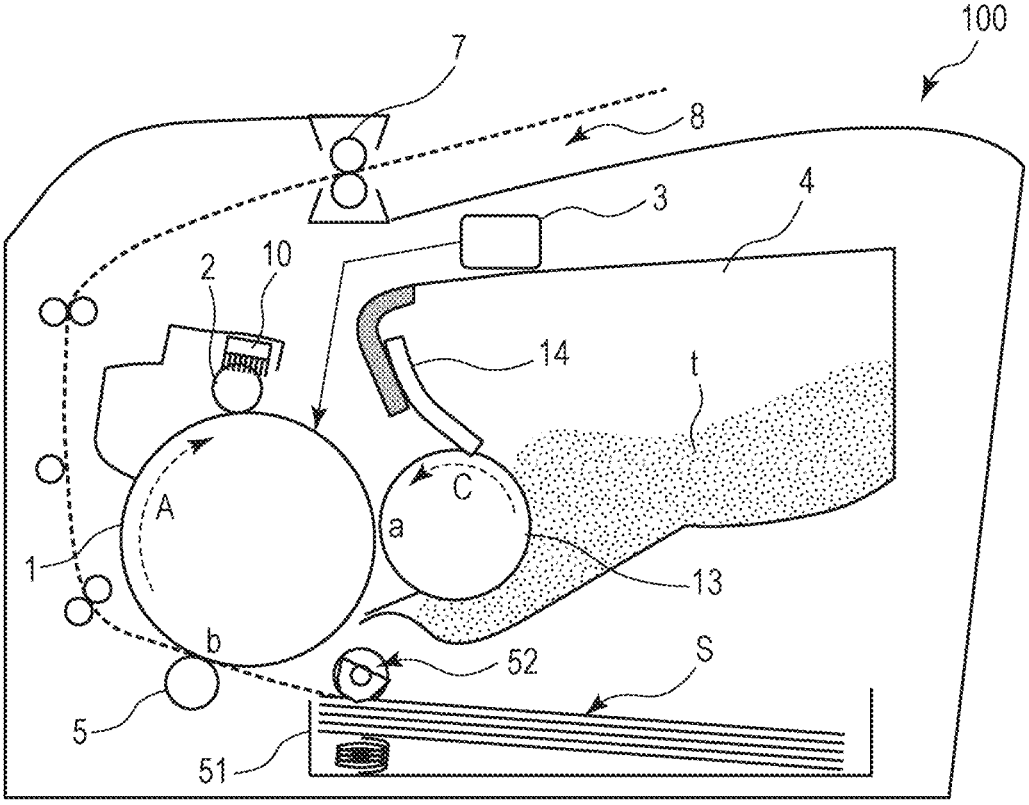
FIG. 9 illustrates a cleanerless configuration.

Next, a cleanerless system in the present embodiment is described with reference to FIG. 9. Transfer residual toner remaining on the photosensitive drum 1 after the transfer step is negatively charged by discharge occurring between the charging roller 2 and photosensitive drum 1, like in the photosensitive drum 1. At this time, the surface of the photosensitive drum 1 is charged so as to have a potential of −700 V. The negatively charged transfer residual toner passes by the charging roller 2 without attaching thereto because of the relationship between the potentials at the charging portion (surface potential of the photosensitive drum 1=−700 V, potential of the charging roller=−1300 V).

The transfer residual toner having passed through the charging portion reaches a laser emitted location to which the laser beam scanner 3 emits a laser beam in the surface of the photosensitive drum 1. Because the amount of the transfer residual toner is not so large and it does not block the laser beam from the laser beam scanner 3, it does not affect the step of forming an electrostatic image (latent image) on the photosensitive drum 1. Of the toner having passed through the laser emitted location, toner in an unexposed portion (surface that is not subjected to laser emission in the photosensitive drum 1) is collected by the developing sleeve 13 at a developing portion by means of electrostatic force. That toner is further collected in the developing device 4 through the developing sleeve 13.

Of the toner having passed through the laser emitted location, toner in an exposed portion (surface subjected to the laser emission in the photosensitive drum 1) is not collected in terms of electrostatic force and stays on the photosensitive drum 1. However, part of the toner may be collected by means of physical force caused by peripheral speed difference between the developing sleeve 13 and photosensitive drum 1. That toner is also collected in the developing device 4 through the developing sleeve 13.

Most of the toner that is not transferred and that remains on the photosensitive drum 1, other than the toner in the exposed portion, is collected in the developing device 4. The toner collected in the developing device 4 is mixed with the tonner accommodated in the developing device 4, and the mixture is used again.

That is, the developing device 4 develops a latent image and collects toner remaining on the photosensitive drum 1 at the same time.

In the cleanerless configuration, because the cleaning blade 6*a* is not included, torque of the photosensitive drum 1 decreases. No brake exists in the longitudinal direction, and thus misregistration tends to occur in the longitudinal direction of the photosensitive drum 1.

Figure 6:
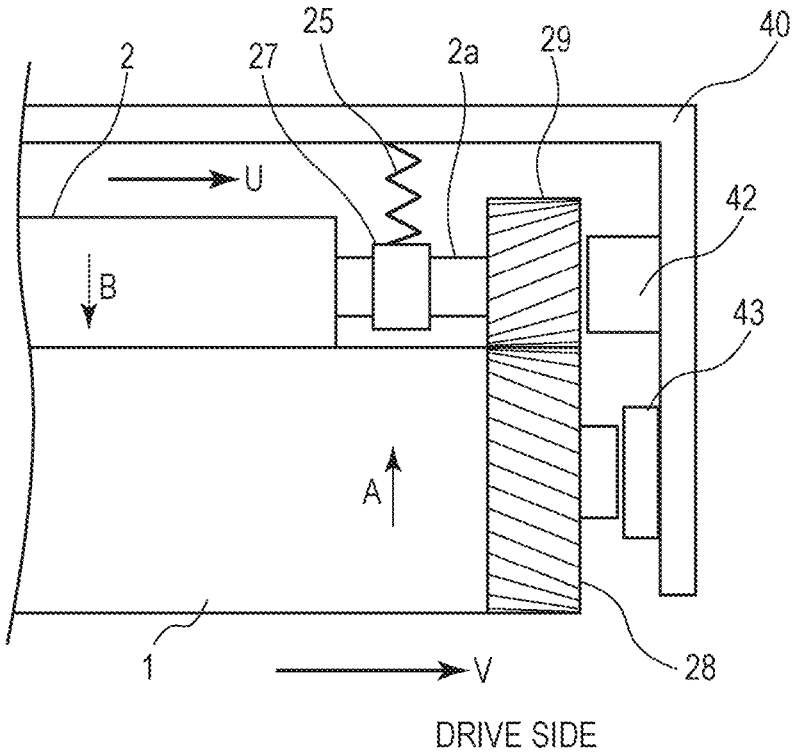
FIG. 6 is a schematic diagram that illustrates a configuration of the charging roller and the photosensitive drum on a drive side according to the second embodiment.

FIG. 6 is a schematic diagram of a configuration of the charging roller and photosensitive drum on the drive side. In the present embodiment, the charging roller 2 is driven through a charging roller drive gear 29 connected to the metal core 2*a* with a peripheral speed difference of 110% with respect to the photosensitive drum 1. The charging roller drive gear 29 has a configuration that receives a driving force by engaging with a gear portion in the coupling member 28 on the photosensitive drum 1.

Because the charging roller 2 is driven with the peripheral speed difference with respect to the photosensitive drum 1, adherents to the charging roller 2 can be made negative at the abutment portion abutting on the photosensitive drum 1 by sliding and rubbing. This enables the adherents to be returned to the photosensitive drum 1 by the potential difference between the charging roller 2 and photosensitive drum 1, and soiling of the surface of the charging roller 2 can be reduced.

The charging roller drive gear 29 is made of a member such as a POM, and has the configuration that receives the driving force by engagement with the gear portion in the coupling member 28 on the drive side of the photosensitive drum 1. Each of the charging roller drive gear 29 and the gear portion in the coupling member 28 has a helical gear shape. This can achieve an increased real contact ratio, and can result in suppression of the occurrence of rotational fluctuation of the charging roller 2.

In the present embodiment, the charging roller drive gear 29 (first helical gear) and the gear portion of the coupling member 28 (second helical gear) have a shape that enables the charging roller 2 and photosensitive drum 1 to receive a thrust on the drive side. The inclination of the teeth of each of the gears is illustrated in FIG. 6.

Positioning the charging roller 2 and photosensitive drum 1 on the drive side leads to a sufficient width of engagement between the charging roller drive gear 29 and coupling member 28 and results in suppression of the occurrence of rotational fluctuation. As portions for positioning the charging roller drive gear 29 and coupling member 28, sliding members 42 and 43 having good sliding characteristics are disposed for the charging roller drive gear 29 and coupling member 28, respectively. Each of the sliding members is the one in which a molding made of a resin, such as POM, POW containing a sliding agent, polycarbonate, polycarbonate containing a sliding agent, or nylon, is press-fitted to the frame 40, bonded thereto, secured thereto by screws, or the like.

Figure 7:
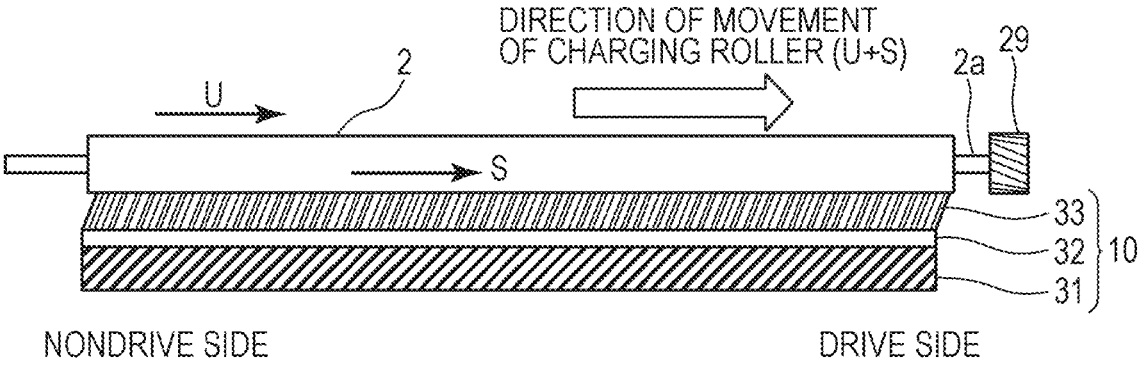
FIG. 7 is a schematic diagram that illustrates a configuration of the charging roller and brush member according to the second embodiment.

The relationship between the charging roller 2 and brush member 10 and advantages in the present embodiment are described with reference to FIG. 7. In the present embodiment, the bristles 33 in the brush member 10 are subjected to tilting treatment toward the drive side. When driving begins in the state where the charging roller 2 abuts on the photosensitive drum 1, the charging roller 2 receives the thrust S from the brush member 10, like in the first embodiment.

When the charging roller 2 receives a rotational driving force in the direction indicated by the arrow B through the charging roller drive gear 29, a thrust U occurs. That is, the charging roller 2 receives a predetermined force (thrust U) in the longitudinal direction of the charging roller from the photosensitive drum 1 (coupling member 28) at the charging roller drive gear 29 (helical gear, force receiving portion). That is, the thrust U is a force acting so as to move the charging roller 2 in the longitudinal direction.

In the present embodiment, the charging roller 2 receives the forces (thrust U, thrust S) at different places, i.e., the charging roller drive gear 29 (force receiving portion) and the contact portion being in contact with the brush member 10. These thrusts U and S act in the same direction in the longitudinal direction. That is, the longitudinal component (thrust U) of the force received through the charging roller drive gear 29 and the longitudinal component (thrust S) of the force received at the contact portion being in contact with the brush member 10 are in the same direction. This enables smooth movement of the charging roller 2 toward the drive side in the longitudinal direction, and thus the charging roller 2 can move to a desired location with stability.

In a comparative example case where the bristles 33 are subjected to tilting treatment toward the opposite side, because the thrust U and thrust S exerted on the charging roller 2 are in the opposite directions, longitudinal positioning the charging roller 2 is not smooth. This results in the occurrence of rotational fluctuation caused by an insufficient contact ratio between the charging roller drive gear 29 and coupling member 28 and a phenomenon in which the charging roller drive gear 29 is detached from the metal core 2*a*. In that case, a charging failure occurs.

In contrast, in the configuration in the present embodiment, as described above, the thrust received by the charging roller 2 through the charging roller drive gear 29 and the thrust received by the charging roller from the bristles 33 act in the same direction. This enables the charging roller 2 to smoothly move to a predetermined location (toward the drive side). The photosensitive drum 1 is also positioned on the drive side, to which the charging roller 2 moves, by a thrust V. That is, the longitudinal component (thrust V) of the force received at the gear portion in the coupling member 28 (second helical gear) is in the same direction as in the thrusts U and S. Thus, longitudinal positioning the charging roller 2 and photosensitive drum 1 on the same side leads to an increased contact ratio and can result in suppression of the occurrence of rotational fluctuation.

In the present embodiment, the cleanerless configuration is used. The present embodiment is also applicable to a configuration including a cleaning device. In that configuration, the thrusts S and U can act in the same direction. In the present embodiment, although the charging roller 2 and photosensitive drum 1 form no intersect angle, a longitudinal thrust can be exerted on the charging roller 2 and photosensitive drum 1, and further advantages are obtainable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-045132, filed Mar. 6, 2015 and No. 2016-028429, filed Feb. 17, 2016, which are hereby incorporated by reference herein in their entirety.

What is claimed is:

1. A charging device for use in an image forming apparatus, the charging device comprising:

a charging member being in contact with an image bearing member and configured to charge the image bearing member while rotating; and a brush member being in contact with the charging member, wherein the charging member includes a force receiving portion that receives a force in a longitudinal direction of the charging member while rotating, wherein the charging member is in contact with the brush member at a place different from a place of the force receiving portion, and wherein a component of the force received by the charging member at the force receiving portion in the longitudinal direction and a component of a force received by the charging member resulting from tilting of bristles in the brush member in the longitudinal direction are in an identical direction.

2. The charging device according to claim 1, wherein an axis of rotation of the image bearing member and an axis of rotation of the charging member intersect with each other, and the force receiving portion is a contact portion where the charging member is in contact with the image bearing member.

3. The charging device according to claim 1, wherein the charging member includes a first helical gear, and the first helical gear is the force receiving portion.

4. The charging device according to claim 3, wherein the image bearing member includes a second helical gear, and when the second helical gear transmits a driving force to the first helical gear, the image bearing member receives a force in the longitudinal direction, and a component of the force received by the second helical gear in the longitudinal direction is in a direction identical to the direction of the component of the force received by the charging member at the force receiving portion in the longitudinal direction.

5. The charging device according to claim 1, wherein the brush member is subjected to tilting treatment.

6. A process cartridge attachable to and detachable from an image forming apparatus, the process cartridge comprising:

an image bearing member;

a charging member being in contact with an image bearing member and configured to charge the image bearing member while rotating; and a brush member being in contact with the charging member, wherein the charging member includes a force receiving portion that receives a force in a longitudinal direction of the charging member while rotating, wherein the charging member is in contact with the brush member at a place different from a place of the force receiving portion, and wherein a component of the force received by the charging member at the force receiving portion in the longitudinal direction and a component of a force received by the charging member resulting from tilting of bristles in the brush member in the longitudinal direction are in an identical direction.

7. The process cartridge according to claim 6, wherein an axis of rotation of the image bearing member and an axis of rotation of the charging member intersect with each other, and the force receiving portion is a contact portion where the charging member is in contact with the image bearing member.

8. The process cartridge according to claim 6, wherein the charging member includes a first helical gear, and the first helical gear is the force receiving portion.

9. The process cartridge according to claim 8, wherein the image bearing member includes a second helical gear, and when the second helical gear transmits a driving force to the first helical gear, the image hearing member receives a force in the longitudinal direction, and a component of the force received by the second helical gear in the longitudinal direction is in a direction identical to the direction of the component of the force received by the charging member at the force receiving portion in the longitudinal direction.

10. The process cartridge according to claim 6, wherein the brush member is subjected to tilting treatment.

11. The process cartridge according to claim 6, further comprising a developing device configured to supply a developing agent to the image bearing member and to form a developed image on the image bearing member.

12. An image forming apparatus comprising:

an image bearing member;

a charging member being in contact with an image bearing member and configured to charge the image bearing member while rotating; and a brush member being in contact with the charging member, wherein the charging member includes a force receiving portion that receives a force in a longitudinal direction of the charging member while rotating, wherein the charging member is in contact with the brush member at a place different from a place of the force receiving portion, and wherein a component of the force received by the charging member at the force receiving portion in the longitudinal direction and a component of a force received by the charging member resulting from tilting of bristles in the brush member in the longitudinal direction are in an identical direction.

13. The image forming apparatus according to claim 12, wherein an axis of rotation of the image bearing member and an axis of rotation of the charging member intersect with each other, and the force receiving portion is a contact portion where the charging member is in contact with the image bearing member.

14. The image forming apparatus according to claim 12, wherein the charging member includes a first helical gear, and the first helical gear is the force receiving portion.

15. The image forming apparatus according to claim 14, wherein the image bearing member includes a second helical gear, and when the second helical gear transmits a driving force to the first helical gear, the image bearing member receives a force in the longitudinal direction, and a component of the force received by the second helical gear in the longitudinal direction is in a direction identical to the direction of the component of the force received by the charging member at the force receiving portion in the longitudinal direction.

16. The image forming apparatus according to claim 12, wherein the brush member is subjected to tilting treatment.

17. The image forming apparatus according to claim 12, further comprising a developing device configured to supply a developing agent to the image bearing member and to form a developed image on the image bearing member, wherein the developing device develops a latent image formed on the image bearing member and collects the developing agent remaining on the image bearing member.

* * * * *